US005746882A

United States Patent [19]

Bell et al.

[11] Patent Number: 5,746,882

[45] Date of Patent: May 5, 1998

[54] STRAP PATH ACCESS APPARATUS AND METHOD FOR STRAPPING MACHINE

[75] Inventors: Lem Bell, Zion; Tim Pearson, Antioch; James Haberstroh, Vernon Hills, all of Ill.

[73] Assignee: Illinois Tool Works Inc., Glenview, Ill.

[21] Appl. No.: 573,457

[22] Filed: Dec. 15, 1995

[51] Int. Cl.[6] ..... B29C 65/06

[52] U.S. Cl. ..... 156/580; 156/73.5; 100/26; 100/33 PB

[58] Field of Search ..... 156/73.5, 580; 100/25, 26, 33 PB

[56] References Cited

U.S. PATENT DOCUMENTS 3,847,071 11/1974 Goodley ..... 100/32
3,913,472 10/1975 Buck ..... 100/4
4,011,808 3/1977 Aoki et al. ..... 100/26
4,016,023 4/1977 Takami ..... 156/359
4,781,110 11/1988 Sakaki et al. ..... 100/26

*Primary Examiner*—James Sells
*Attorney, Agent, or Firm*—Dvorak & Orum

[57] ABSTRACT

Disclosed is a pivotal strap path access cover with an integral feed wheel mechanism for a strapping machine. The strap path access cover is pivotable, without the use of tools, to an open inspection position, such that the feed wheel integral with the access cover is also moved clear of the inspection area, allowing unhampered access to the inspection area for removal of strap debris or correction of various malfunctions.

6 Claims, 3 Drawing Sheets

STRAP PATH ACCESS APPARATUS AND METHOD FOR STRAPPING MACHINE

BACKGROUND OF THE INVENTION

1. Field of the Invention

The present invention relates to an apparatus and method for providing convenient access to areas in a strapping machine which are prone to strap jamming, misfeeding, and other problems. In particular, the present invention provides a pivotable main access cover with an integral feed wheel. The access cover may be opened and pivoted away from the body of the strapping machine without the need for removal of fasteners, or separation of elements of the access cover from the body of the strapping machine.

2. Description of Related Art

In the past, strapping machines required detachable strap guides and access covers to allow service access to problem areas of the strapping machines. Access to certain areas of the strapping machine is important because of normally encountered problems such as strap jamming, misfeeding, and excess accummulation of strap debris. In particular, access to areas near the feed and tensioning wheels and direction changing strap guides is critical because of the generally close space tolerances at these points. Prior art strapping machines required detachable elements for providing the necessary access. However, the temporary detachment of elements from the strapping machine presents several problems. Tools are usually required to remove and install the necessary fasteners on the detached elements. Detached elements, such as access covers and guides, are subjected to the increased threat of damage or loss as a result of being separated from the strapping machine.

Those prior art strapping machines which allow for removal of elements without tools provide for only limited access to the necessary areas.

The foregoing deficiencies of the prior art strapping machines are addressed and solved by the present invention.

SUMMARY OF THE INVENTION

It is an object of the invention to provide a strapping machine having complete and convenient access to the entire strap path of the feed and tensioning mechanism.

It is a further object to provide a pivotable strap path cover which is held in place and is also releasable via a latching mechanism which requires no tools for operation.

It is yet another object to provide for simple positioning and adjustment of a movable feed wheel incorporated in the access cover.

These and other objects are satisfied by the present invention.

DESCRIPTION OF THE PREFERRED EMBODIMENT

Figure 1:
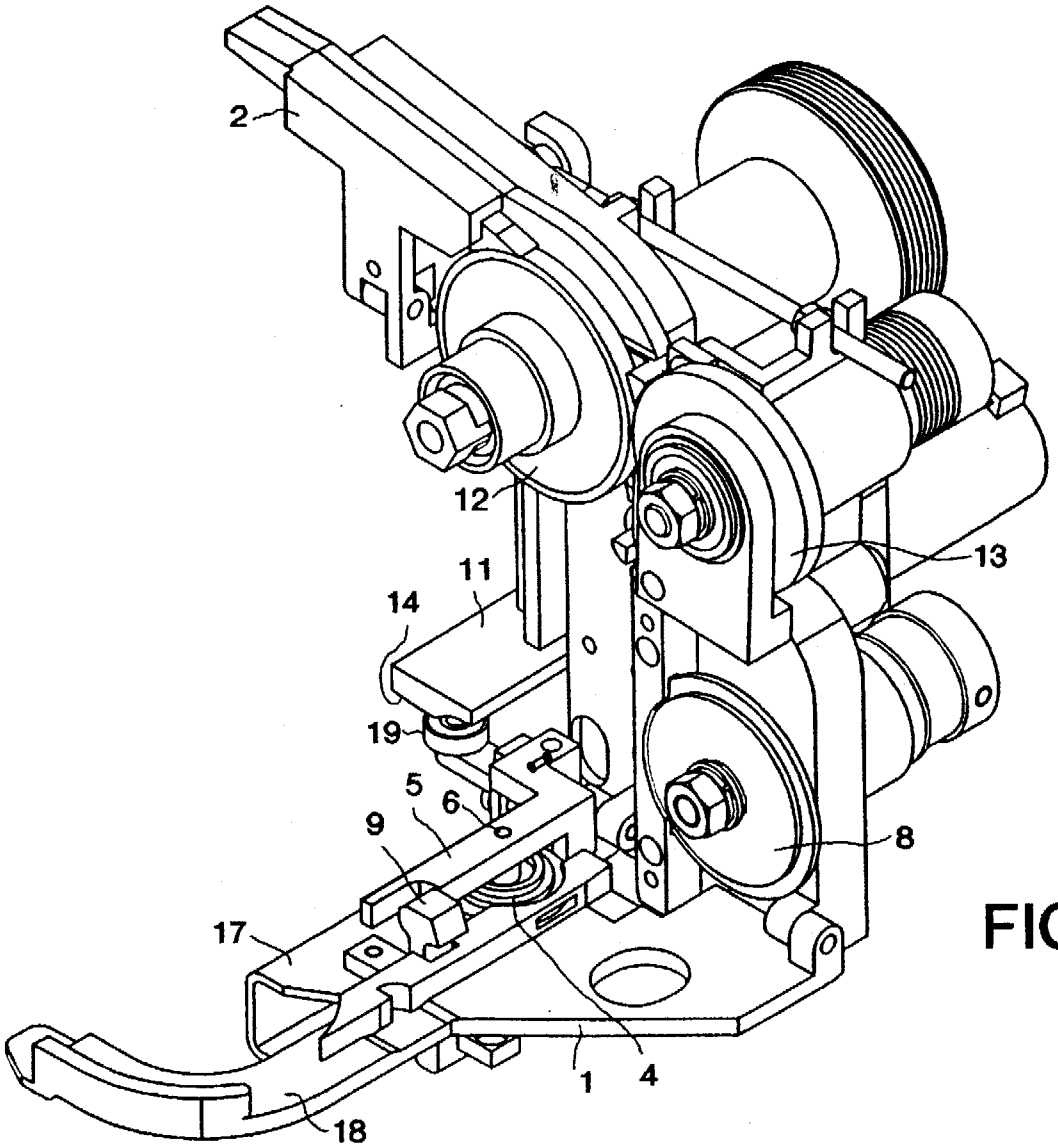
FIG. 1 is a top front perspective view of the present invention.

As shown in FIG. 1, the present invention discloses a main access cover 1 pivotably mounted to a frame of a strapping machine. In one embodiment, the main access cover 1 is hinged at two points adjacent a lower edge of the cover. At a point distal the hinged edge, the cover 1 terminates in a curved access cover guide 18. The guide 18 in one embodiment directs the strap around a first tension wheel 12. In one embodiment, the invention may include a first tension wheel 12 and a second tension wheel 13 having parallel central axes, tension wheels 12 and 13 being fixed to the frame of the strapping machine and located at a point above the feed wheels. Second feed wheel 8 may be fixed to the frame and located directly below second tension wheel 13. First feed wheel 4 is attached to and rotatable within the main access cover 1 about a feed wheel lever shaft 6. A feed wheel lever 5 is pivotably attached to the main access cover 1, the feed wheel lever 5 being spring biased in a direction which angles the first feed wheel 4 against the strap in a manner which firmly presses the strap against the opposing second feed wheel 8.

A spring loaded latch 9 is mounted on the main access cover 1. When the main access cover 1 is in the upright, closed, operating position, the latch 9 secures the main access cover in this position. Upon applying an external force to the latch handle 17, the latch 9 is moved out of the locked position, allowing the main access cover to be pivoted down into the open position. Pulling open the latch handle 17 also acts against the spring biasing the first feed wheel 4 against the strap, moving the first feed wheel 4 away from the strap and opposing second feed wheel 8, thereby creating sufficient clearance between the first feed wheel 4 and the strap and other elements to facilitate opening and closing of the main access covers. In one embodiment, the main access cover 1 is formed such that during operation in the closed position, only a small segment of the first feed wheel 4 circumferential surface is exposed to the strap, via a slot which is present in the main access cover 1. The slot may be formed in a feed wheel receiving block 22. The circumferential surface of the first feed wheel 4 is withdrawn from the slot upon pulling open the lateral handle 17.

A pivotable actuation lever 11 having a cammed surface 14 may be used to control the position of the first feed wheel 4 and the first tension wheel 12. Before the strapping machine enters the strap feed mode, the cammed surface of the pivotable actuation lever 11 holds the first feed wheel 14 away from the strap, until the strap feed mode begins. The cammed surface 14 may ride along a roller surface 19 when the main access cover 1 is in the closed, operating position.

Figure 3:
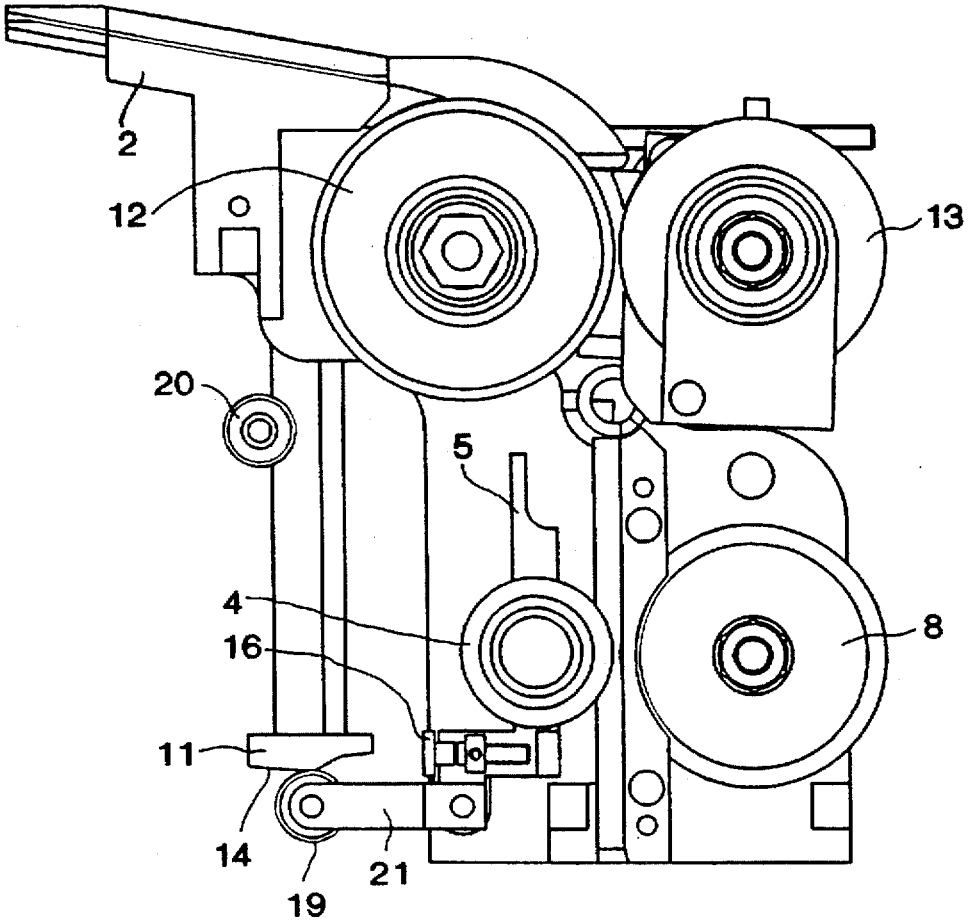
FIG. 3 is a front view of the present invention.

Referring now to FIG. 3, the actuation lever 11 may be strategically positioned by the action of the strapping machine main space cam against the main cam roller 20. As the actuation lever is urged by the main space cam, the actuation lever cam surface 14 acts against the roller surface 19, thereby urging the first feed wheel actuation lever 21 against the feed wheel lever 5 to alterately engage and disengage the first feed wheel 4 with the strap.

Figure 2:
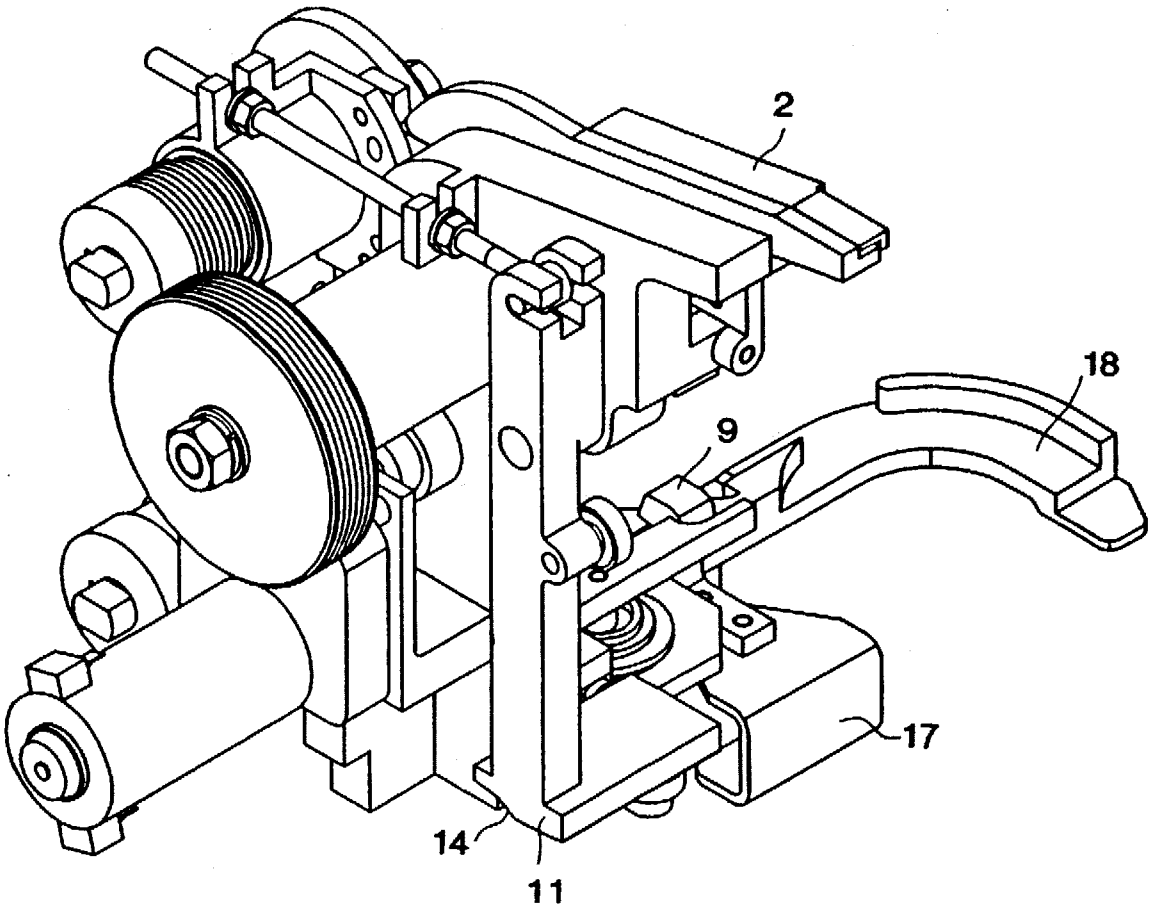
FIG. 2 is a top back perspective view of the present invention.

Referring now to FIGS. 2 and 3, upper access cover 2 is spring biased to open when the main access cover 1 is in the open position. When in the closed, operating position, the upper access cover 2 provides a guide path for the strap downstream of the first tension wheel 12.

In operation, the pivotable main access cover 1 with the integrated first feed wheel 4 allows for unrestricted access to the critical areas between the feed wheels and between the tensioning wheels, greatly facilitating the ability of an operator to clear debris and correct strap misfeeds in this area. Because the operation of cleaning and troubleshooting this area is made simple, while maintaining and enhancing the performance of the normal feeding and tensioning modes, the overall performance of any strapping machine incorporating these features will be greatly enhanced.

The invention described above encompasses the range of equivalents to which it is entitled, and is only limited by the following claims.

We claim:

1. An apparatus for facilitating access to the path of a strap in a strapping machine having a frame, a feed wheel fixed to the frame, a secondary feed wheel, and a first and second strap tensioning wheel mounted to said frame, said tensioning wheels having respective operating axis disposed parallel to each other such that a strap path is defined between each wheel, said feed wheel located below said second tensioning wheel, comprising:

a main access cover having a lower edge and a terminal edge, said lower edge pivotally mounted to said frame of the strapping machine, a first strap feeding wheel rotatable attached to the terminal edge of the main access cover and adapted to guide the strap into the machine, said first wheel opposing said secondary feed wheel, and a first feed wheel lever pivotably attached to said first feed wheel, said lever including a biasing spring attached thereto, said biasing spring adapted to bias said feed wheel lever in a manner which presses a feed strap against said secondary feed wheel, a spring-loaded latching means, wherein upon unlatching the latching means, the main access cover is pivotable from a closed operating position to an open access position, wherein said latching means causes simultaneous movement of said biasing spring such that said first feed wheel is moved away from said secondary wheel, allowing access to a strap path without the detachment of an element from the strapping machine.

2. The apparatus for facilitating access to the path of a strap in a strapping machine as claimed in claim 1, further comprising a feed wheel receiving block, wherein the first feed wheel partially extends through a slot in the feed wheel receiving block when the main access cover is in the closed operating position, and is retracted from the slot when the main access cover is opened.

3. The apparatus for facilitating access to the path of a strap in a strapping machine as claimed in claim 2, further comprising hinge points disposed at said lower edge of the main access cover, and an access cover strap guide disposed at a distal end of the main access cover.

4. The apparatus for facilitating access to the path of a strap in a strapping machine as claimed in claim 3, further comprising a feed wheel pressure adjuster, wherein pressure exerted by the first feed wheel against a strap fed between the first and second feed wheels is held at a selected pressure level by the feed wheel pressure adjuster.

5. The apparatus for facilitating access to the path of a strap in a strapping machine as claimed in claim 4, further comprising an upper access cover which cooperates with an actuator lever having a main cam roller, which said roller is acted upon by a main cam, wherein the upper access cover is moved to an open position upon opening of the main access cover.

6. The apparatus for facilitating access to the path of a strap in a strapping machine as claimed in claim 5, further comprising an actuator lever cam surface disposed at a bottom portion of the actuator lever, a first feed wheel actuator lever acting in cooperation with the feed wheel lever, and a roller surface which cooperates with the actuator lever cam surface, wherein the main cam acts upon the actuation lever which cooperates via its actuator lever cam surface with the roller surface and first feed wheel actuator lever to hold the first feed wheel at a distance from the strap until the strapping machine enters the strap feed mode.

* * * * *